US010323397B2

(12) United States Patent
Mimms

(10) Patent No.: US 10,323,397 B2
(45) Date of Patent: Jun. 18, 2019

(54) PLUMBING INSERT CLEANSING DEVICE

(71) Applicant: Norman Mimms, Houston, TX (US)

(72) Inventor: Norman Mimms, Houston, TX (US)

( * ) Notice: Subject to any disclaimer, the term of this patent is extended or adjusted under 35 U.S.C. 154(b) by 0 days.

(21) Appl. No.: 15/908,766

(22) Filed: Feb. 28, 2018

(65) Prior Publication Data

US 2018/0245322 A1 Aug. 30, 2018

Related U.S. Application Data

(60) Provisional application No. 62/465,072, filed on Feb. 28, 2017.

(51) Int. Cl.
*E03F 9/00* (2006.01)
*E03C 1/306* (2006.01)

(52) U.S. Cl.
CPC ..... *E03C 1/306* (2013.01); *E03F 9/00* (2013.01)

(58) Field of Classification Search
CPC ..... E03C 1/306; E03F 9/00
USPC ..... 4/255.01–255.11
See application file for complete search history.

(56) References Cited

U.S. PATENT DOCUMENTS 6,098,212 A * 8/2000 Rogan ..... E03C 1/306 15/104.33
8,122,902 B2 * 2/2012 Malka ..... B08B 9/0321 137/15.05

* cited by examiner

*Primary Examiner* — Christine J Skubinna
(74) *Attorney, Agent, or Firm* — Law Office of Jeff Williams PLLC; J. Oliver Williams

(57) ABSTRACT

A plumbing insert cleansing device having a mounting plate, a nozzle, a solution port, and a hose is provided herein. The cleaning device is configured to permit for the pressurized cleaning and clearing of debris through a cleanout in the waste pipes of a structure. The mounting plate has a plurality of apertures and is configured to fit within the cleanout. The nozzle is coupled to a first aperture in the mounting plate and the solution port is coupled to a second of the apertures. The hose is separated between the solution port and the nozzle. Water enters through the nozzle and a cleaning solution enters through the solution port. They are mixed downstream prior to exiting at a higher pressure.

13 Claims, 4 Drawing Sheets

PLUMBING INSERT CLEANSING DEVICE

CLAIM OF PRIORITY

This application claims the benefit of U.S. Provisional Application No. 62/465,072, filed 28 Feb. 2017. The information contained therein is hereby incorporated by reference.

BACKGROUND

1. Field of the Invention

The present application relates generally to a device used to clean waste water pipes in a home, and in particular to a device inserted into the cleanout of a home to inject pressurized water and detergent into the waste water pipes.

2. Description of Related Art

Most buildings that are inhabited are plumbed for water. Water is provided via a water main located near the street. The water is pressure regulated within water lines to provide functioning use of the water in the home. After use, water is sent out through a waste pipe back toward the street where it connects to the sewage system of a city. The general function of water plumbing in a home as described is equally applicable to homes with septic systems. The waste pipe is not under pressure as seen in the water pipes. Commonly, waste flows down through the waste pipe as a result of gravity.

Waste pipes can become clogged if the waste passed through them becomes lodged or the water is unable to carry it away. Clogged waste pipes can lead to backups of waste which, in extreme conditions, may manifest itself inside the house through the nearest drains. This may lead to damage and major inconveniences in the home. Waste pipes typically include one or more cleanouts positioned in accessible spots around the foundation of the home or in an exterior wall. They include an angled sloped portion that is angled out to the street. The idea being to direct what comes down the cleanout to move in a direction out and away from the home. To unclog the waste pipes, plumbers will often send a flexible line down the cleanout that is oscillated and rotated within the waste pipe to forcefully clear the debris. Various types of debris may be found. An example may be that of roots or vegetation. Another example is human waste.

A problem with present systems is that a cleanout is typically only used when a clog is detected. At this time it may be too late to avoid damage. Additionally, no real preventative maintenance or method of maintaining the waste pipes exists or even customarily thought of as a good practice. A device is needed that allows a home owner the ability to provide maintenance to the waste pipes without the costly use of a plumber. It is desired that such device be simple to use, relatively quiet, and effective.

SUMMARY OF THE INVENTION

It is an object of the present application to provide a device used to treat and/or maintain waste pipes in a structure. Specifically, the plumbing insert cleansing device of the present application is configured to provide for the injection of pressurized water flow into the waste pipes and the inclusion of a cleaning solution. The device is configured to operate with water provided from the structure under typical water pressures. The device is inserted into existing cleanouts at the structure and can spray water forwards and backwards in the waste pipes.

It is a further object of the present application to provide a plumbing insert cleansing device for incorporation into exterior water plumbing of a structure. The device is configured to permit above ground attachment and operation to facilitate non-owner service to the structure of multi-tenant buildings.

Ultimately the invention may take many embodiments. Use of this assembly increases available preventative measures to ensure proper flow through waste pipes in a convenient manner. In this way, this device overcomes the disadvantages inherent in the prior art.

The more important features of the device have thus been outlined in order that the more detailed description that follows may be better understood and to ensure that the present contribution to the art is appreciated. Additional features of the device will be described hereinafter and will form the subject matter of the claims that follow.

Many objects of the present device will appear from the following description and appended claims, reference being made to the accompanying drawings forming a part of this specification wherein like reference characters designate corresponding parts in the several views.

Before explaining at least one embodiment of the system in detail, it is to be understood that the device is not limited in its application to the details of construction and the arrangements of the components set forth in the following description or illustrated in the drawings. The device is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present system. It is important, therefore, that the claims be regarded as including such equivalent constructions insofar as they do not depart from the spirit and scope of the present system.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
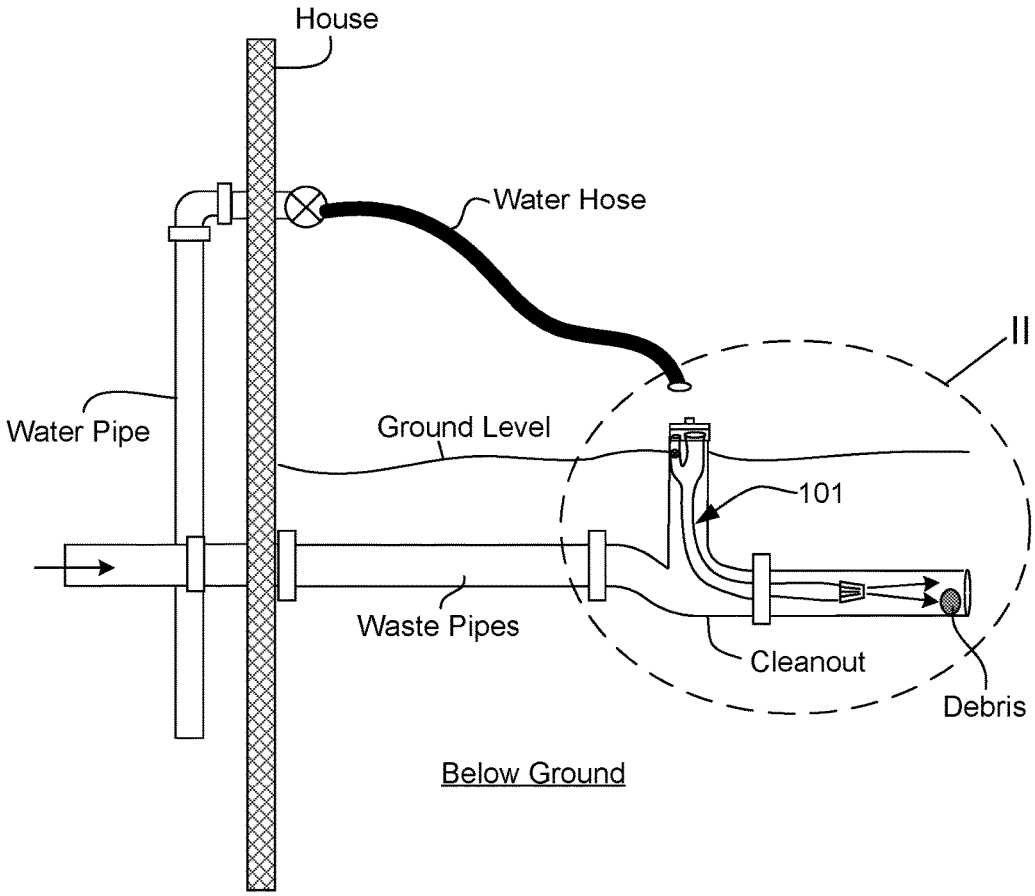
FIG. 1 is a side view of a plumbing insert cleansing device with general environmental structure according to an embodiment of the present application.

While the device and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The system and method in accordance with the present application overcomes one or more of the above-discussed problems commonly associated with conventional methods and devices used to treat and/or maintain waste pipes in a structure. Specifically, plumbing insert cleansing device of the present application is configured to provide for the injection of pressurized water flow into the waste pipes and the inclusion of a cleaning solution. The device is configured to operate with water provided from the structure under typical water pressures. The device is at least partially inserted into existing cleanouts adjacent the structure and can spray water forwards and optionally backwards in the waste pipes. These and other unique features of the device are discussed below and illustrated in the accompanying drawings.

The system and method will be understood as to its operation, from the accompanying drawings, taken in conjunction with the accompanying description. It should be understood that various components, parts, and features of the device may be combined together and/or interchanged with one another, all of which are within the scope of the present application, even though not all variations and particular embodiments are shown in the drawings. It should also be understood that the mixing and matching of features, elements, and/or functions is expressly contemplated herein so that one of ordinary skill in the art would appreciate from this disclosure that the features, elements, and/or functions of one embodiment may be incorporated into another embodiment as appropriate, unless otherwise described.

The system and method of the present application includes a mounting plate in communication with the cleanout; one or more hoses, pressure return ports, and pressurized release ports. The hoses connect to the mounting plate and are fitted to accept communication with a conventional water hose. Water enters through a nozzle on the hose and passes down through the one or more hoses. A cleaning solution is added to the one or more hoses to selectively mix with the water. Mixture of the water and the cleaning solution work to clean and clear debris both downstream of the cleanout and upstream of the cleanout. Additional features and functions of the device are illustrated and discussed below.

Referring now to the Figures wherein like reference characters identify corresponding or similar elements in form and function throughout the several views. The following Figures describe the device of the present application and its associated features. With reference now to the Figures, an embodiment of the modular observation device and method of use are herein described. It should be noted that the articles "a", "an", and "the", as used in this specification, include plural referents unless the content clearly dictates otherwise.

Referring now to FIG. 1 in the drawings, a plumbing insert cleansing device 101 is illustrated. Device 101 is illustrated with a selected amount of environmental structure so as to properly orient the location of its use. Device 101 is ideally suited for use in home structures within waste water cleanouts. Typically only a selected portion of the cleanout is visible above ground. In some instances the cleanout is located in a wall of the home with the cap being mostly the only visible portion. Both waste pipes and water lines are provided to a house. The water line is used by device 101 to provide water pressure. This may be done through a water hose or through direct plumbing.

Figure 2:
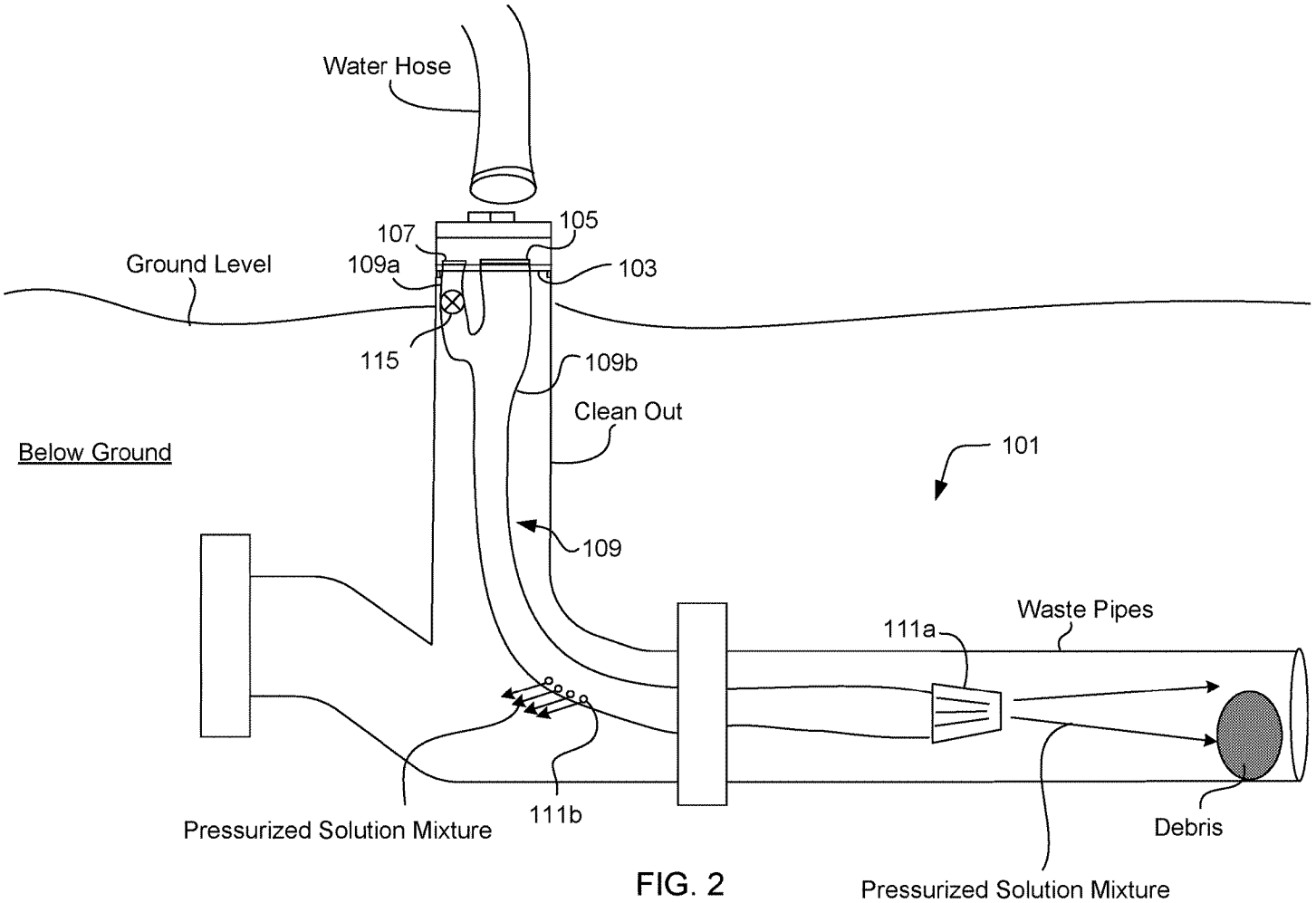
FIG. 2 is an enlarged side view of the plumbing insert cleansing device of FIG. 1.
Figure 3:
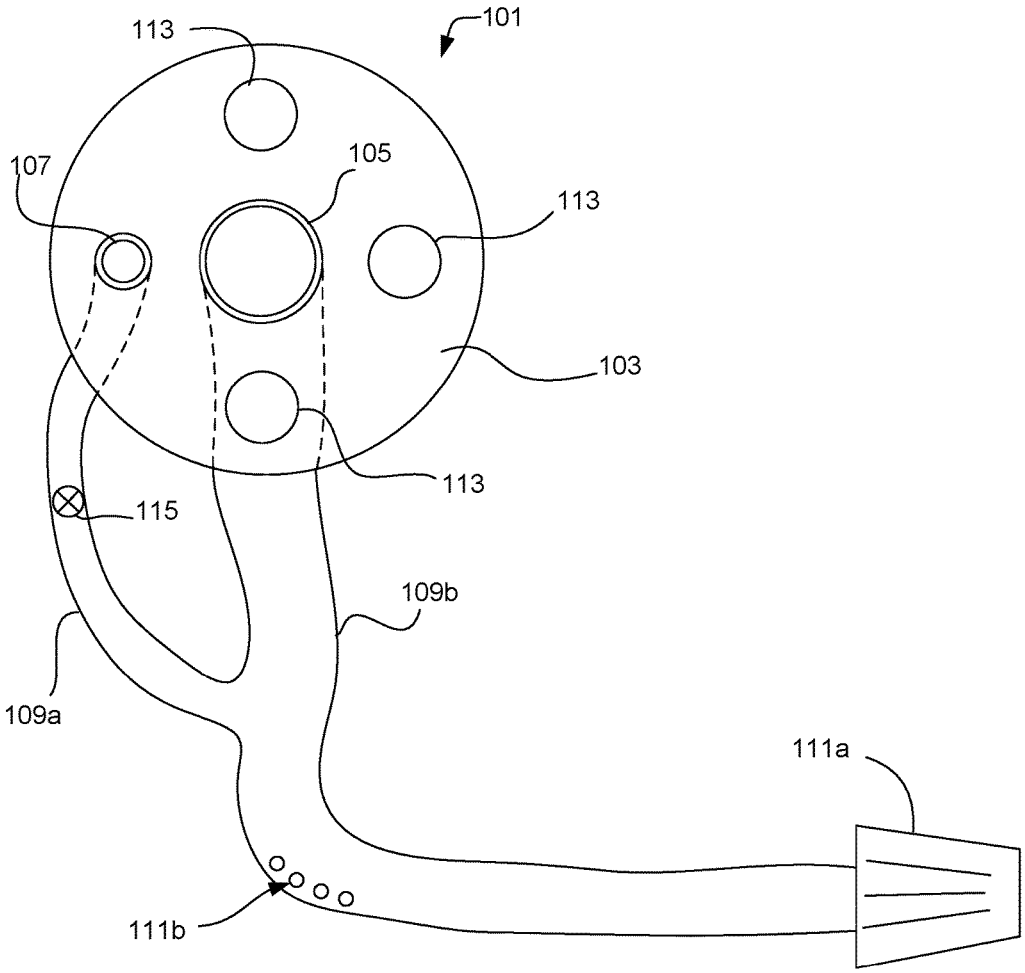
FIG. 3 is a view of the plumbing insert cleansing device of FIGS. 1 and 2.

Referring now also to FIGS. 2 and 3 in the drawings, an enlarged views of device 101 is illustrated so as to assist in viewing and describing it functions, features, and parts. FIG. 3 is used to show device 101 alone. For discussion purposes, both FIGS. 2 and 3 are helpful in understanding device 101. Device 101 includes a mounting plate 103, a nozzle 105, solution port 107, hose 109, and exit port 111*a*/111*b*. Mounting plate 103 is in communication with both solution port 107 and nozzle 105. Other ports exist on mounting plate 103, namely pressure return ports 113.

Mounting plate 103 has a plurality of apertures and is generally planar in contour and shape. Mounting plate 103 is configured to fit within a cleanout. Nozzle 105 is coupled to a first of the plurality of apertures in the mounting plate and solution port 107 is coupled to a second of the plurality of apertures in the mounting plate. Hose 109 has a first input end and a second input end. The first input end is coupled to the nozzle 105 and the second input end is coupled to the solution port 107. Hose 109 further includes an output end opposite the first input end and the second input end. A combined solution mixture is discharged through an exit port in the output end.

Mounting plate 103 is configured to fit within the top portion of the cleanout. The cap of the cleanout is removed and plate 103 is inserted. Plate 103 rests near the opening of the cleanout on a lip, which prevents device 101 from falling into the waste pipes. As noted, plate 103 includes a number or ports or connection locations. Firstly, nozzle 105 is used to connect to a water source. Typically the water source conceived of is that of a water hose from a typical water faucet. Other water sources are possible however. It is important that pressurized water is fed through nozzle 105 and into hose 109. Nozzle 105 is coupled adjacent and in line with a first aperture in mounting plate 103.

Solution port 107 is located within plate 103 as well and is in communication with a second aperture in mounting plate 103. Solution port 107 is configured as an open port and designed to accept a cleansing solution. There are various types of possible cleansing solutions, both commercial and household. The cleansing solution may be as simple as liquid dish soap. It is preferred that the cleaning solution be in liquid form to assist in integrating it with the pressurized water.

Hose 109 may consist of one or more individual hoses and are ideally flexible. As seen in the figures, hose 109 includes hose 109*a* (first input end) and hose 109*b* (second input end). Hose 109*a* is in communication with solution port 107 and is routed so as to join into hose 109*b* downstream of plate 103. Hose 109*b* is the main hose and is the one directly in fluid communication with the water hose. Downstream of the junction of hose 109*a* and hose 109*b* is termed the output end of hose 109*b*. The cleaning solution is inserted into hose 109*a* wherein the flow is regulated through the use of a ball valve 115. Valve 115 acts to regulate flow of cleaning solution and to help prevent back pressure build up from traveling through the solution port 107. Valve 115 is configured to permit a single flow direction only. The cleaning solution is mixed with the water at the joining of the two hoses to form a mixed solution.

Ports 113 are located in plate 103 so as to be a relief point in the case of water pressure build up in the waste pipe. Some obstructions may take time to dissolve or dislodge. The introduction of pressurized liquid in the waste pipes can lead to a back up of liquid in the pipe. To prevent the liquid from backing up into the structure (home/business) ports 113 permit a ground level exit location for excess liquid.

In use, the cleaning solution is placed through the solution port 107 and pressurized water is placed through nozzle 105. Valve 115 regulates the amount of solution that can mix with the liquid. The solution and liquid mix into a solution liquid mixture in the output end of the hose. When the water and cleaning solution is mixed, it is sent under pressure down the waste pipe toward debris that may be potentially obstructing flow. In the event that the debris is impassible or temporarily immovable, water pressure may build up in the waste pipe and come back toward the cleanout. To avoid potential damage from backing up the water into the home, ports 113 are provided to give the water an exit point. It also provides the user an indication of any potential problems with the debris. Therefore, when backed up, the mixed solution of water and cleaning solution will pass out through ports 113 as opposed to exiting into the home. Additionally, the user may quickly see the backup forming and cut off the supply of water.

Hose 109*b* further includes an exit port. The exit port may be any aperture or exit location in hose 109*b*. For example, exit port 111*a* is located at the end of hose 109*b* in the output end. Port 111*a* is configured to further pressurize the mixed solution so as to produce a high powered stream of fluid. The fluid passes down in the waste pipe. The pressure is sufficient to merely provide a steady stream of water to wash away loose debris or to provide a method of directly spraying the debris to break it down. Thereby use may not only maintain a clean waste pipe but also has the power to unclog the waste pipe. The cleaning solution may be configured to assist in preventing vegetation intrusion into the waste pipe and to lubricate the waste pipe as well. Device 101 may further include exit port 111*b*. Port 111*b* is configured to direct a portion of the pressurized mixed solution in an upstream or opposing direction, as compared to the downstream direction for port 111*a*. One or more ports 111*b* may be used and located along the length of hose 109*b* in the output portion of the hose.

Water and cleaning solution may be run through the waste pipe when desired by a user and for any amount of time. The frequency may be adjusted to suit environmental conditions and the usage of the particular home. An example would be to use the device with the water for 10-15 minutes once a month. More or less time and frequency is also suitable. When finished, the user merely lifts out device 101 from the cleanout and replaces the cleanout cap. The water hose is removed from device 101.

Figure 4:
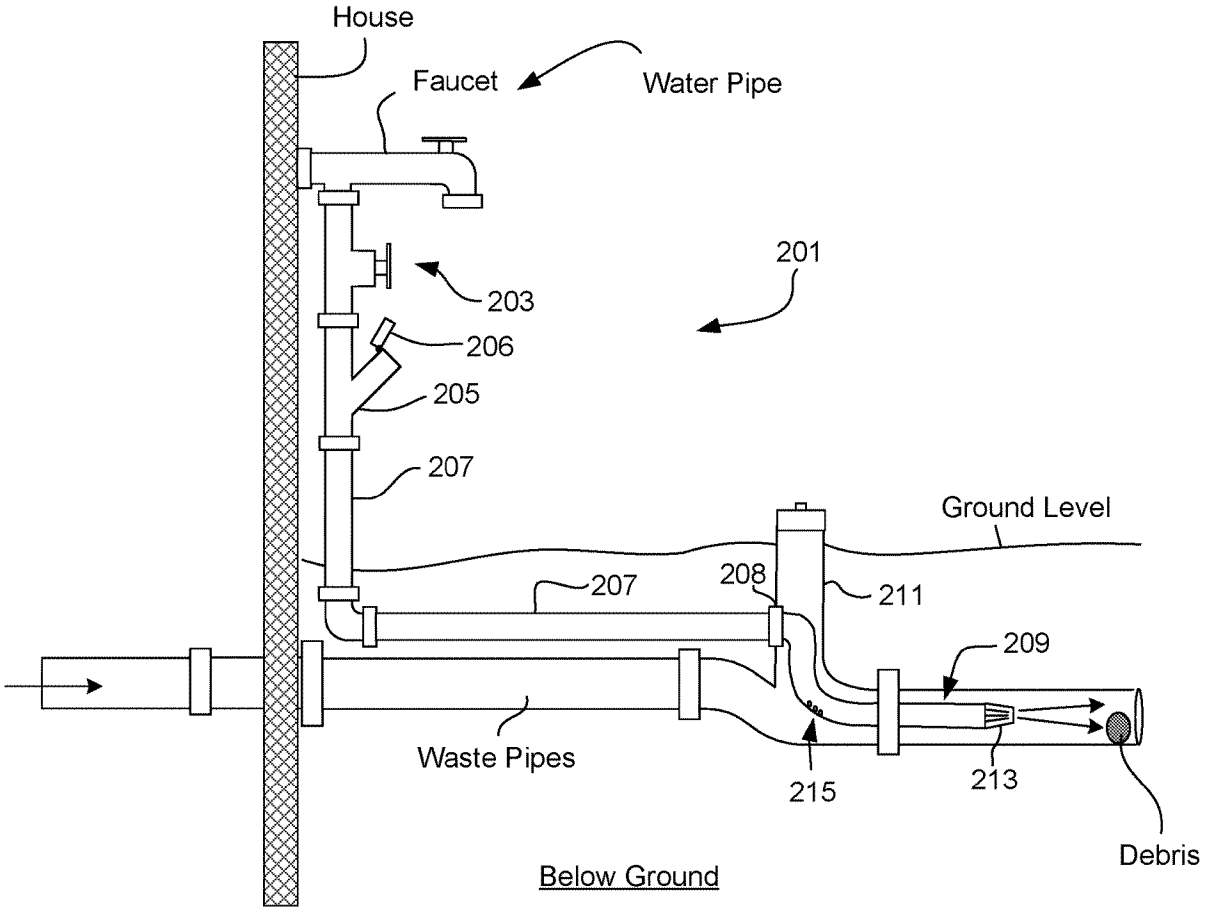
FIG. 4 is an alternate embodiment of the plumbing insert cleansing device of FIG. 1.

Referring now also to FIG. 4 in the drawings, an alternate embodiment of device 101 is illustrated. Plumbing insert cleaning device 201 is similar in form and function to that of device 101. Device 201 is configured to also accept a pressurized liquid source, mix an amount of solution with the liquid source, and then pass that mixed liquid solution into a waste pipe to remove debris and obstructions. Device 201 is however configured to operate directly with the water lines of the home. A garden hose is not needed to route a supply of liquid to the cleanout.

Device 201 includes a cleaner valve 203, a filler tube 205, a plurality of pipe segments 207, and a hose 209. Cleaner valve 203 is coupled directly to an exterior water faucet such that the connection location is upstream of the faucet valve. This allows cleaner valve 203 to have access to a constant amount of pressurized liquid water. Filler tube 205 is in communication with cleaner valve 203 and is located downstream. Filler tube 205 includes a cap 206 that is configured to selectively open and close to permit the introduction of a solution. Filler tube 205 may also include a valve to regulate the flow of solution exiting filler tube 205. Pipe segments 207 are used to join and extend the run of liquid water from cleaner valve 203 and filler tube 205. Pipe segments 205 route the water under ground and in time couple to a portion of the cleanout.

Device 201 may further include a cleanout 211 having an aperture 208 for the passage of at least one of pipe segments 207 and/or hose 209. Hose 209 is flexible and extends within the waste pipes and is configured to direct the flow of pressurized liquid downstream in the waste pipes. Hose 209 has a input end coupled to pipe segments 207 and an output end located downstream in the waste pipe. The output end includes an exit port 213 similar in form and function to that of exit port 111*a*. In operation, pressurized liquid is passed through the filler tube 205, plurality of pipe segments 207, and through the hose 209 for discharge through the exit port 213. Like in device 101 with respect to exit port 111*b*, device 201 also include similar secondary exit port 215. Port 215 is similar in form and function to that of port 111*b*.

In operation of device 201, it is preferred that the lid of cleanout 211 is removed to act similarly to that of return ports 113 to release pressure in the waste pipe in the event of a blockage or backup. Device 101 is used by inserting device 101 into a cleanout by locating the hose within a waste pipe beneath the cleanout. The hose extends downstream. A solution is placed in solution port 107 and a water pressure source is coupled to nozzle 105. The water pressure source is typically the ordinary water supply in the home/business. In some embodiments, the user may adjust the exit port 111*a* to modify the pressure of the liquid when discharged and even the spray pattern. Both devices 101 and 201 provide a suitable cleaning and maintenance method for a home or business and have particular advantages as described above.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A plumbing insert cleansing device, comprising:

a mounting plate having a plurality of apertures, the mounting plate being planar in contour;

a nozzle coupled to a first of the plurality of apertures in the mounting plate;

a solution port coupled to a second of the plurality of apertures in the mounting plate;

a hose having a first input end and a second input end, the first input end is coupled to the nozzle and the second input end is coupled to the solution port; and an output end on the hose opposite the first input end and the second input end, the output end configured to permit the discharge of a liquid from within the hose, the output end including an exit port;

wherein the nozzle and the solution port are configured to accept a volume of liquid.

2. The device of claim 1, wherein the hose is flexible.

3. The device of claim 1, wherein the first input end and the second input end of the hose combine into the exit port end of the hose.

4. The device of claim 1, wherein the mounting plate is configured to rest within a cleanout for a waste line, the hose extending within the cleanout into the waste line; wherein a liquid is passed through the nozzle and solution port to exit the exit port under pressure.

5. The device of claim 4, wherein the pressurized liquid removes obstructions within the waste line.

6. The device of claim 1, further comprising:

a valve located in the second input end of the hose, the valve configured to regulate the flow of fluid through the second input to a single direction.

7. The device of claim 1, wherein the exit port increases the pressure of the liquid exiting the output end.

8. The device of claim 1, further comprising:

a secondary exit port formed in the output end of the hose, the secondary exit port configured to discharge liquid in an opposing direction to the liquid exiting the exit port.

9. The device of claim 1, further comprising:

a plurality of return ports formed in the mounting plate.

10. A method of clearing debris from a waste line, comprising:

inserting a cleaning device into a cleanout, the cleaning device having:

a mounting plate configured to rest within the cleanout, the mounting plate having a plurality of apertures;

a nozzle coupled to a first of the plurality of apertures in the mounting plate;

a solution port coupled to a second of the plurality of apertures in the mounting plate; and a hose having a first input end and a second input end, the first input end is coupled to the nozzle and the second input end is coupled to the solution port, the hose also including an output end opposite the first input end and the second input end, the output end configured to permit the discharge of a liquid from within the hose via an exit port;

locating the hose within a waste pipe beneath the cleanout;

inserting a solution into the solution port; and coupling a water pressure source to the nozzle and inducing a flow of liquid through the hose;

wherein the flow of liquid mixes with the solution in the solution port and exits the exit port under pressure, the combined solution liquid mixture configured to remove obstructions from the waste pipe.

11. The method of claim 10, further comprising:

diverting a portion of the combined solution liquid mixture through a secondary exit port to run upstream in the waste line.

12. The method of claim 10, further comprising:

releasing back pressure through the mounting plate, the mounting plate including one or more return ports.

13. The method of claim 10, further comprising:

passing the solution through a valve in the second end of the hose, the valve configured to permit a singular flow direction.

* * * * *